US010787004B2

(12) United States Patent
Ohnishi

(10) Patent No.: US 10,787,004 B2
(45) Date of Patent: Sep. 29, 2020

(54) PRINTING APPARATUS AND PRINT METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/404,761

(22) Filed: May 7, 2019

(65) Prior Publication Data

US 2019/0351684 A1 Nov. 21, 2019

(30) Foreign Application Priority Data

May 17, 2018 (JP) ..... 2018-095652

(51) Int. Cl.
*B41J 11/00* (2006.01)

(52) U.S. Cl.
CPC ..... *B41J 11/002* (2013.01)

(58) Field of Classification Search
CPC .... B41J 11/002; C09D 11/101; C09D 11/322; B41M 5/0011
USPC ..... 347/6, 100, 102
See application file for complete search history.

(56) References Cited

U.S. PATENT DOCUMENTS

| | | | | |
|---|---|---|---|---|
| 8,556,401 | B2 * | 10/2013 | Oyanagi | C09D 11/36 347/100 |
| 8,888,246 | B2 * | 11/2014 | Makuta | B41M 5/0047 347/100 |
| 9,327,495 | B2 * | 5/2016 | Ohnishi | B41J 2/01 |
| 2012/0075394 | A1 | 3/2012 | Ohnishi | |
| 2017/0051150 | A1 | 2/2017 | Kawaharada et al. | |

FOREIGN PATENT DOCUMENTS

| | | |
|---|---|---|
| EP | 2762320 | 8/2014 |
| EP | 3312013 | 4/2018 |
| JP | 2013241565 | 12/2013 |
| WO | 2017135425 | 8/2017 |

OTHER PUBLICATIONS

"Search Report of Europe Counterpart Application", dated Sep. 10, 2019, p. 1-p. 12.

* cited by examiner

*Primary Examiner* — An H Do
(74) *Attorney, Agent, or Firm* — JCIPRNET

(57) ABSTRACT

Disclosed is a printing apparatus which performs printing on a medium in an inkjet mode. The printing apparatus includes inkjet heads and an ultraviolet irradiation section that is an energy ray irradiation section. In this printing apparatus, the ink is an ink containing a solvent and generating heat in accordance with ultraviolet rays. The ultraviolet irradiation section applies the ultraviolet ray to the ink on the medium to evaporate at least a portion of the solvent in the ink. When 45% by volume or more of the solvent evaporates from an initial solvent amount, the viscosity of the ink is 50 mPa·sec or more.

18 Claims, 5 Drawing Sheets

PRINTING APPARATUS AND PRINT METHOD

CROSS REFERENCE TO RELATED APPLICATIONS

This application claims the priority benefit of Japanese Patent Application No. 2018-095652, filed on May 17, 2018. The entirety of the above-mentioned patent application is hereby incorporated by reference herein and made a part of this specification.

TECHNICAL FIELD

The present disclosure relates to a printing apparatus and a print method.

DESCRIPTION OF THE BACKGROUND ART

Conventionally, as an ink for an ink jet printer, an evaporation drying type ink which fixes on a medium by evaporation of a solvent is widely used. In recent years, an ink (instantaneous drying ink) in which the ink itself generates heat by irradiation with energy rays such as ultraviolet rays has been proposed as an evaporation type ink (see, for example, Patent Literature 1).

Patent Literature 1: International Publication No. 2017/135425

SUMMARY

In the conventional configuration, for example when an ink is dried by heating a medium with a heater or the like, the ink is indirectly heated via the medium. On the other hand, when an instantaneous drying ink is used, the ink itself is caused to generate heat, so that it becomes possible to directly heat the ink while suppressing an influence of heating on the surroundings and the like. Further, when the instantaneous drying ink is used, the ink on a medium is irradiated with energy rays immediately after landing on the medium, so that the ink can be efficiently dried in a short time before smearing of the ink (such as intercolor smearing) occurs.

However, since the configuration using the instantaneous drying ink is a technique that has been proposed shortly, it is desired to further study various features. Based on such consideration, it is desired to perform printing of high quality more appropriately. Accordingly, the present disclosure provides a printing apparatus and a print method capable of solving the above problems.

The inventor of this application has conducted intensive studies on a configuration using an instantaneous drying ink. As a result of the intensive studies, it has been found that when the instantaneous drying ink is used, a phenomenon called a coffee stain phenomenon may be likely to occur. The coffee stain phenomenon is, for example, a phenomenon in which, in an ink on a medium, a coloring material (pigment or the like) of the ink moves to a peripheral edge having a high evaporation rate, so that the ink fixes eccentrically to the peripheral edge during drying. In this case, since the coloring material fixes eccentrically to the peripheral portion, pixels formed by dots of the ink (print dots, landing liquid droplets) have, for example, a donut shape (or ring shape) that, while the color in the central portion is thin, the color in the peripheral edge is thick. In this case, the dots of the ink mean, for example, dots formed by ink droplets landing on the medium. Further, in this case, it is conceivable that a thin color portion is formed on a printed matter which is a printed product, and an average density of colored color decreases. It is also conceivable that image quality deteriorates due to these effects.

On the other hand, the inventor of this application, through his keen studies and researches, has found out that the reason why the coffee stain phenomenon tends to occur is related to the temperature of the ink during drying. More specifically, when an instantaneous drying ink is used, the ink is irradiated with energy rays such as ultraviolet rays to be caused to generate heat. This also heats the ink to a high temperature to rapidly dry the ink. In this case, the ink can be heated to a higher temperature (for example, 80° C. or higher) as compared with a case where the ink is indirectly heated by heating a medium with a heater or the like. However, in this case, it is conceivable that the viscosity of the ink temporarily lowers due to elevation of the temperature of the ink, and, for example, a flow of the ink component occurs from the central portion to the peripheral edge within the ink dot. As a result, it is conceivable that a coloring material of the ink such as a pigment tends to move to the peripheral edge of the dot, and the coffee stain phenomenon is likely to occur.

Here, in order to prevent the coffee stain phenomenon from occurring as described above, it seems that it is sufficient to suppress a temperature increase of the ink, for example, so as not to lower the viscosity of the ink. However, in the case of heating the ink while suppressing the temperature increase, ink smearing (intercolor smearing or the like) is likely to occur due to prolongation of the time until the ink is sufficiently dried. Thus, only by suppressing the temperature increase of the ink, it may be difficult to properly perform high-quality printing. Therefore, the inventor of this application contemplated that an ink whose viscosity rapidly increases due to evaporation of a solvent is used without merely suppressing the temperature increase of the ink, whereby the viscosity of the ink is prevented from lowering. Further, the inventor of this application confirmed through tests that the coffee stain phenomenon can be appropriately prevented by such a method. Furthermore, the inventor of this application, through his keen studies and researches, has found out features necessary for obtaining the above-mentioned effects, and the present disclosure was achieved.

In order to solve the above problems, the present disclosure provides a printing apparatus which performs printing on a medium in an inkjet mode. The printing apparatus includes an inkjet head which ejects ink to the medium and an energy ray irradiator which applies energy rays. The ink is an ink containing a solvent and generating heat in accordance with the energy ray. The energy ray irradiator applies the energy ray to the ink on the medium to evaporate at least a portion of the solvent in the ink. The energy ray irradiator applies the energy ray to the ink on the medium, so that the viscosity of the ink is 50 mPa·sec or more when 45% by volume or more of the solvent evaporates from an initial solvent amount which is the amount of the solvent contained in the ink at the time of ejection from the inkjet head.

With such a configuration, for example, even if the ink is heated by irradiation with energy rays so that the temperature of the ink becomes high, it is possible to appropriately prevent the viscosity of the ink from becoming too low. Consequently, for example, when the instantaneous drying ink is used, it possible to appropriately prevent the coffee stain phenomenon. In the conventional configuration, the coffee stain phenomenon is likely to occur when using an ink containing a solid coloring material such as a pigment. On the other hand, with such a configuration, even when an ink containing a solid coloring material is used, the coffee stain phenomenon can be appropriately prevented. Consequently, for example, it is possible to more appropriately perform high-quality printing. In this configuration, for example, ultraviolet rays can be suitably used as the energy rays. In this case, for example, a configuration using an LED (UV-LED) that generates ultraviolet rays (UVLED irradiator) or the like can be suitably used as the energy ray irradiator.

In the case of drying the ink by irradiation with energy rays, if a boiling point of the solvent of the ink is low, bumping of the solvent or the like is likely to occur. When the solvent bumps during drying of the ink, problems such as surface roughening of the ink may occur. Thus, in this configuration, as the ink, for example, it is preferable to use an ink in which a liquid having a boiling point of 100° C. or higher occupies 50% by weight or more in a solvent contained in the ink at the time of ejection from the inkjet head. With such a configuration, for example, bumping of the solvent of the ink or the like can be made less likely to occur. When the ink adhering to the medium is irradiated with energy rays, it is preferable that the energy ray irradiator irradiate the ink with energy rays such that the solvent of the ink does not boil. With such a configuration, for example, surface roughening of the ink or the like can be appropriately prevented.

Here, when energy rays are applied such that the solvent of the ink does not boil, it seems that ink smearing is likely to occur due to a mild temperature increase of the ink. On the other hand, according to the above configuration, by using the ink whose viscosity rapidly increases with evaporation of the solvent, for example even when the temperature increase of the ink is mild, it is possible to appropriately suppress occurrence of smearing. Thus, with such a configuration, for example, it is possible to appropriately prevent the coffee stain phenomenon, roughening of the ink, and smearing.

In this case, as the ink, for example, an ink containing a thickening substance which is a substance that increases the viscosity of the ink when the amount of the solvent in the ink decreases may be used. In this case, for example, the thickening substance aggregates when the amount of the solvent in the ink decreases, thereby increasing the viscosity of the ink. With such a configuration, by irradiating the ink with energy rays, it is possible to rapidly and appropriately increase the viscosity of the ink. The thickening substances can also be considered as a substance which increases the viscosity of the ink more rapidly than when the ink does not contain the substance.

More specifically, in this configuration, as the ink, an ink or the like containing latex resin particles may be used. In this case, as the latex resin particles, particles of a latex resin dispersed in a solvent in a state in which the particle size is 30 nm to 1200 nm can be suitably used, for example. Further, in this case, for example, the viscosity of the ink increases, as a distance between the latex resin particles decreases in the state in which 45% by volume or more of the solvent evaporates from the initial solvent amount. This is considered to be due to the fact that as the distance between the latex resin particles decreases, for example, an attractive force and a frictional force acting between the particles increase. With such a configuration, by irradiating the ink with energy rays, it is possible to rapidly and appropriately increase the viscosity of the ink.

As the ink, an ink containing a polymeric substance or an oligomer dissolved in a solvent may be used, for example. In this case, for example, in the state in which 45% by volume or more of the solvent evaporates from the initial solvent amount, the intermolecular force of the polymeric substance or oligomer increases, and, at the same time, entanglement occurs between the molecules, so that the viscosity of the ink increases. In this case, the ink whose viscosity is increased changes, for example, into a gel state. According to this configuration, by irradiating the ink with energy rays, it is possible to rapidly and appropriately increase the viscosity of the ink. As the ink, for example, an ink containing a polymerizable substance which is a substance to be polymerized by irradiation with energy rays may be used. In this case, the polymerizable substance is, for example, a monomer or an oligomer. Further, in this case, for example, the viscosity of the ink increases as the polymerization reaction occurs simultaneously with evaporation of the solvent of the ink. According to this configuration, by irradiating the ink with energy rays, it is possible to rapidly and appropriately increase the viscosity of the ink.

As the ink, for example, a colloidal ink or the like may be used. The colloidal ink contains coloring material-coated resin particles which are particles obtained by coating a coloring material such as a pigment with a resin such as a polymer resin. According to this configuration, for example, by coating with a resin, for example, even when a pigment or the like is used as a coloring material, electrostatic repulsion between pigments can be reduced. Also, in this case, in a way identical or similar to that in the case of using the ink containing the latex resin particles, for example, the viscosity of the ink increases, as a distance between the coloring agent-coated resin particles decreases in the state in which 45% by volume or more of the solvent evaporates from the initial solvent amount.

As the ink, for example, an ink containing a cellulose fiber which is a fiber of cellulose may be used. In this case, for example, the cellulose fiber may further be contained in the ink in each configuration described above. As the cellulose fiber, for example, it is more preferable to use a cellulose nanofiber which is a cellulose fiber having an average fiber length of 1 μm or less. The average fiber length of the cellulose fiber is more preferably 700 nm or less (for example, about 50 nm to 700 nm). With such a configuration, for example, by irradiating the ink with energy rays, it is possible to more rapidly and appropriately increase the viscosity of the ink. As the cellulose fiber, a colorless and transparent one can be suitably used. With such a configuration, for example, the cellulose fiber can be appropriately added to the ink while suppressing the influence on the color of the ink. For example, the cellulose fiber may be added to the ink in a state of being coated with a resin. In this case, the ink includes, for example, resin particles having cellulose fibers coated with a resin such as a polymer resin.

The scope of this disclosure may include a print method having technical features equivalent to those of the printing apparatus described so far. Such a print method may provide similar effects.

According to the disclosure, for example, it is possible to more appropriately perform high-quality printing.

BRIEF DESCRIPTION OF THE DRAWINGS

FIGS. 1A and 1B are a top view and a side cross-sectional view illustrating a simplified example of the configuration of a main portion of the printing apparatus 10.

FIG. 2A is a view illustrating a conventional drying model; FIG. 2B is a view illustrating a drying model of this example; FIG. 2C is a graph comparing an ink density distribution in states illustrated in FIGS. 2A and 2B.

FIG. 3A is a view schematically illustrating latex resin particles (Latex particles) contained in the latex ink; FIG. 3B is a graph illustrating an example of a difference in viscosity change due to ink.

DESCRIPTION OF EMBODIMENTS

Figure 1A:
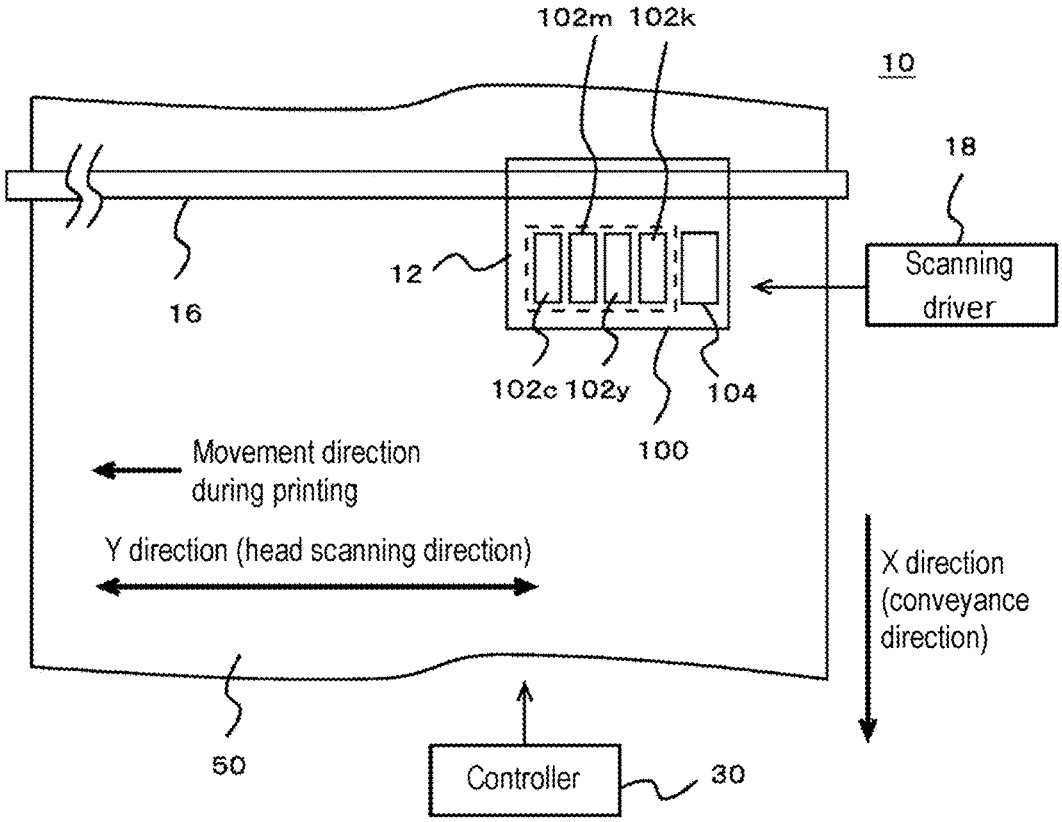
FIGS. 1A and 1B are views illustrating an example of a printing apparatus 10 according to an embodiment of the disclosure.
Figure 1B:
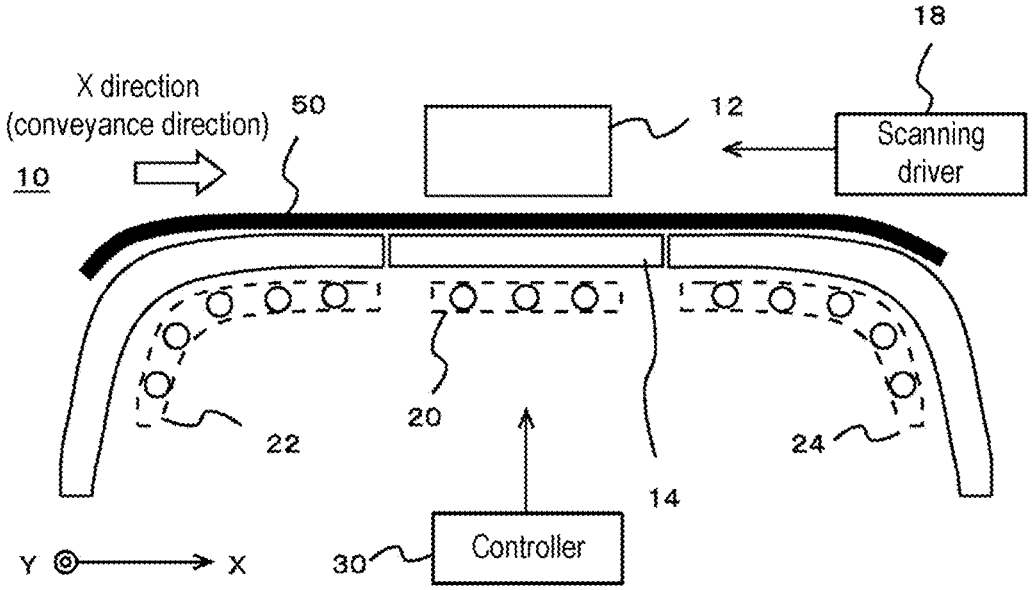

Hereinafter, embodiments of the present disclosure will be described with reference to the drawings. FIGS. 1A and 1B illustrate an example of a printing apparatus 10 according to an embodiment of the disclosure. FIGS. 1A and 1B are a top view and a side cross-sectional view illustrating a simplified example of the configuration of a main portion of the printing apparatus 10. Except for aspects hereinafter described, the printing apparatus 10 may be configured identically or similarly to the known printing apparatuses. For example, the printing apparatus 10 may be further configured identically or similarly to the known printing apparatuses, in addition to the configurations described below.

In this embodiment, the printing apparatus 10 is an inkjet printer that performs inkjet printing. The printing apparatus 10 includes a head portion 12, a medium supporter 14, a guide rail 16, a scanning driver 18, a printing heater 20, a pre-heater 22, an after-heater 24, and a controller 30. Further, the printing apparatus 10 is a serial type inkjet printer that prompts the head portion 12 to perform main scans. In this case, the main scan is, for example, an operation of ejecting ink (ink droplets) while moving in a preset main scanning direction (Y direction in the drawing, head scanning direction). Prompting the head portion 12 to perform main scans technically means prompting inkjet heads of the head portion 12 to perform main scans. In this embodiment, the printing apparatus 10 executes serial mode printing in a multi-pass scan mode in which multiple main scans are performed at each of positions on a medium 50 to be printed, for example.

The head portion 12 is a portion that ejects ink onto the medium 50, and includes a carriage 100, a plurality of inkjet heads (print heads), and an ultraviolet irradiation section 104. The carriage 100 is a holding member that holds the inkjet heads and the ultraviolet irradiation section 104. In this embodiment, the inkjet heads of the head portion 12 include an inkjet head 102*c*, an inkjet head 102*m*, an inkjet head 102*y*, and an inkjet head 102*k* (hereinafter referred to as inkjet heads 102*c* to 102*k*) as illustrated in the drawings. These inkjet heads are installed side by side in the main scanning direction to be aligned in line in a sub scanning direction (X direction in the drawing) orthogonal to the main scanning direction.

The inkjet heads 102*c* to 102*k* are inkjet heads that eject inks of mutually different colors and eject ink of each color of a process color that is a basic color used for full color expression. More specifically, the inkjet head 102*c* ejects cyan (C color) ink. The inkjet head 102*m* ejects magenta (M color) ink. The inkjet head 102*y* ejects yellow (Y color) ink. The inkjet head 102*k* ejects black (K color) ink. In this embodiment, as the ink of each color of CMYK, for example, ink containing a pigment of each color of CMYK is used. In this case, the pigment is an example of a solid coloring material.

In this embodiment, as the ink (color ink) ejected from the inkjet heads 102*c* to 102*k*, an evaporation drying type ink is used. In this case, the evaporation drying type ink is, for example, an ink which evaporates a solvent to fix on the medium 50. The solvent is, for example, a liquid which dissolves or disperses other components in the ink. The evaporation drying type ink can be considered as an ink containing a solvent in an amount of 30% by weight or more, for example. The content of the solvent in the evaporation drying type ink is more preferably 70% by weight or more. In this case, as the solvent, a liquid corresponding to the type of ink is used. For example, in the case of aqueous ink, an aqueous solvent such as water is used as a solvent. In the case of a solvent type ink, an organic solvent is used as a solvent. The solvent is not limited to a specific liquid, and it is conceivable to use various liquids such as water, a liquid obtained by mixing water with one or more solvents (organic solvents), and a liquid obtained by mixing a plurality of solvents.

The evaporation drying type ink used as a color ink in this embodiment is an ink (instantaneous drying ink) irradiated with an energy ray to generate heat. The fact that the ink is irradiated with an energy ray to generate heat is, for example, a fact that the ink absorbs the applied energy ray to generate heat itself. In this case, the color ink used in this embodiment can be considered as an ink containing a solvent and generating heat in accordance with an energy ray.

In this embodiment, ultraviolet light (UV light) is used as the energy ray. In this case, the color ink can be considered as a color ink (UV instantaneous drying color ink) instantaneously dried by irradiation with ultraviolet rays. In this case, as the color ink, for example, an ink containing an ultraviolet absorber (UV absorber) is used. The ultraviolet absorber is an example of an energy ray absorber that absorbs energy rays and generates heat. The ultraviolet absorber can be considered as a substance for heating and drying the solvent in the ink momentarily in accordance with irradiation with ultraviolet rays. As the ultraviolet absorber, it is preferable to use a substance (a substance that absorbs ultraviolet rays of the emission wavelength of the ultraviolet irradiation section 104) that appropriately absorbs ultraviolet rays generated by the ultraviolet irradiation section 104 in the head portion 12. With such a configuration, for example, the color ink is irradiated with ultraviolet rays to be caused to appropriately generate heat and can function as an instantaneous drying ink. Depending on the composition of the color ink, it is also conceivable to use a component having an ultraviolet absorbing action as any component of an ink vehicle (for example, coloring material, resin, solvent, or the like). In this case, instead of adding a dedicated ultraviolet absorber for an intended purpose of causing the ink to generate heat, other components (for example, coloring material, resin, solvent, or the like) in the ink may also serve as the function of the ultraviolet absorber. The instantaneous drying ink to be used in this embodiment can be considered as an ink that generates heat by conversion of energy (UV light energy) of ultraviolet rays to be applied into thermal energy.

Further, in this embodiment, as the color ink, an ink (ink having rapidly high viscosity evaporative drying characteristics) whose viscosity rapidly increases as the solvent evaporates is used. More specifically, for example, when the amount of the solvent contained in the ink at the time of ejection from each of the inkjet heads 102*c* to 102*k* is defined as an initial solvent amount, by irradiation of the ink on the medium 50 with ultraviolet rays, the viscosity of the ink reaches 50 mPa·sec or more once 45% by volume or more of the solvent evaporates from the initial solvent amount. With this configuration, for example, when the ink is dried by irradiation with ultraviolet rays, the viscosity of the ink can be sufficiently increased in a short time. Regarding the ink to be used in this embodiment, the features relating to such viscosity increase will be described in more detail later. Also, the ink to be used in this embodiment may have features identical or similar to those of known evaporation drying type inks, except for points described above or to be described below. For example, the ink to be used in this embodiment may further contain components (such as a dispersant) identical or similar to those of known inks.

In the head portion 12 of this embodiment, the ultraviolet irradiation section 104 is an example of an energy ray irradiation part and UV irradiators, and applies ultraviolet rays to color ink adhering to the medium 50, thereby causing the color ink to generate heat. With this configuration, for example, at least a portion of the solvent in the ink can be evaporated by efficiently and appropriately heating the color ink. In this embodiment, as an ultraviolet light source in the ultraviolet irradiation section 104, for example, UVLED (UV-LED irradiators) which is an LED which generates ultraviolet rays is used. In this case, the ultraviolet irradiation section 104 can be considered as a UVLED irradiator. With such a configuration, for example, it is possible to appropriately and efficiently apply ultraviolet rays in a necessary wavelength range. As the UVLED, UVLED having a central wavelength of light emission of 400 nm or less can be suitably used. More specifically, in this case, it is conceivable that the UVLED applies ultraviolet rays having an emission center at 360 nm to 390 nm, for example, with an intensity of about 0.1 Joule/cm$^2$ to 5 Joule/cm$^2$. The wavelength of the ultraviolet ray generated by the UVLED is not limited to the above-described wavelength, and may be any wavelength as long as the instantaneous drying ink to be used can be appropriately heated.

In this embodiment, the ultraviolet irradiation section 104 is disposed at a position behind the inkjet heads 102*c* to 102*k* during the main scan while aligning the position in the sub scanning direction with the inkjet heads 102*c* to 102*k*. With this configuration, the ultraviolet irradiation section 104 applies ultraviolet rays after the inkjet heads 102*c* to 102*k* eject the color ink to each position to be printed on the medium 50. Consequently, the ultraviolet irradiation section 104 causes the color ink to generate heat and vaporizes and evaporates at least a portion of the solvent of the color ink. With this configuration, for example, the color ink can be efficiently dried in a short time.

The medium supporter 14 is a table-shaped member (platen) that supports the medium 50, and supports the medium 50 so as to face the head portion 12. In this embodiment, the medium supporter 14 houses the print heater 20, the pre-heater 22, and the after-heater 24 therein. The guide rail 16 is a rail member that guides the movement of the head portion 12 during the main scanning operation.

The scanning driver 18 is a driver that prompts the head portion 12 to perform a scanning operation that moves relative to the medium 50. In this case, prompting the head portion 12 to perform the scanning operation means, for example, prompting the inkjet heads 102*c* to 102*k* in the head portion 12 to perform the scanning operation. In this embodiment, the scanning driver 18 prompts the head portion 12 to perform main scans and sub scans as the scanning operation. In this case, the scanning driver 18 prompts the head portion 12 to perform the main scan, thereby prompting the inkjet heads 102*c* to 102*k* to eject color ink to each position of the medium 50. In addition, the ultraviolet irradiation section 104 is moved together with the inkjet heads 102*c* to 102*k* during the main scan, whereby ultraviolet rays are applied to the color ink on the medium 50. In this example, the printing apparatus 10 is a unidirectional printer that performs only main scan in one direction (unidirection) indicated by an arrow as a moving direction during printing in the drawing. The scanning driver 18 prompts the head portion 12 to perform sub scan in the intervals between main scans (every pass scan) to sequentially change the position of the medium 50 that faces the head portion 12. In this case, the sub scan refers to, for example, an operation of moving relative to the medium 50 in the sub scanning direction orthogonal to the main scanning direction. More specifically, in this embodiment, the scanning driver 18 conveys the medium 50 in a conveyance direction parallel to the direction indicated as the X direction in the drawing, thereby prompting the head portion 12 to perform sub scan. In this case, the medium 50 is conveyed in the conveyance direction (medium conveyance direction) indicated by an arrow in the drawing by using a roller or the like not illustrated, for example.

The print heater 20, the pre-heater 22, and the after-heater 24 are heaters for heating the medium 50. Among them, the print heater 20 is a heater for heating the medium 50 at a position facing the head portion 12 (a position below the head portion 12). By using the print heater 20, for example, it becomes possible to more efficiently heat the ink on the medium 50. In this case, the configuration of the printing apparatus 10 of this embodiment can also be considered as a configuration in which the ink is dried using the ultraviolet irradiation section 104 and the print heater 20 together.

Here, when the heating temperature in the print heater 20 is high, for example, the inkjet head in the head portion 12 is heated, so that problems such as nozzle clogging are likely to occur. In this case, the nozzle clogging means, for example, that the nozzle of the inkjet head is clogged by drying of ink. Thus, the heating temperature by the print heater 20 is preferably set to 70° C. or lower. In this embodiment, as described above, it is possible to efficiently heat ink using the ultraviolet irradiation section 104. Thus, it is more preferable that the heating temperature by the print heater 20 be set to a sufficiently low temperature for the purpose of suppressing the influence of environmental temperature, making the temperature of the medium 50 constant, and the like. Also in this case, by using the print heater 20, the evaporation condition of the solvent in the ink can be appropriately fixed. More specifically, for example, the print heater 20 heats a region facing the print heater 20 at a temperature closer to the room temperature (for example, about 50° C. or lower, more specifically, for example, about 30° C. to 50° C.). The heating temperature of the medium 50 by the print heater 20 is preferably 40° C. or less, more preferably 35° C. or less. With this configuration, for example, the influence of environmental temperature and the like can be appropriately suppressed while suppressing problems such as nozzle clogging.

The pre-heater 22 is a heater that heats (preheats) the medium 50 on the upstream side of the head portion 12 in the conveyance direction. By using the pre-heater 22, for example, the initial temperature of the medium 50 can be appropriately adjusted before reaching the position of the head portion 12. In this case, the heating temperature of the medium 50 by the pre-heater 22 is also preferably set to a sufficiently low temperature (for example, 50° C. or lower, preferably 40° C. or lower, more preferably 35° C. or lower) for the purpose of, for example, suppressing the influence of environmental temperature. The after-heater 24 is a heater that heats the medium 50 on the downstream side of the head portion 12 in the conveyance direction. By using the after-heater 24, for example, it is possible to more reliably dry the ink and to prevent the solvent from remaining before the printing is completed. Further, by using the after-heater 24, for example, it is possible to enhance the adhesion of the ink to the medium 50. It is conceivable that the heating temperature of the medium 50 by the after-heater 24 is set to, for example, about 30° C. to 50° C. The after-heater 24 can be considered as, for example, a heater for post-heating (post-dryers), and the like for completely removing residual solvent components at the time of heating by the print heater 20. The heating temperature of the after-heater 24 may be set to a high temperature of a certain extent in a range lower than or equal to a heatproof temperature of the medium 50 to be used.

As described above, in this embodiment, at least a portion of the solvent in the ink is evaporated using the ultraviolet irradiation section 104. In this case, the ink can be dried mainly by irradiation with ultraviolet rays. Thus, some or all of the print heater 20, the pre-heater 22, and the after-heater 24 may be omitted depending on the environment of using the printing apparatus 10 and the desired quality of printing. As the print heater 20, the pre-heater 22, and the after-heater 24, various known heaters may be used. More specifically, as the print heater 20, the pre-heater 22, and the after-heater 24, for example, various heaters, hot air blowers, and the like (for example, a heat transfer heater, a warm air heater, an infrared light heater, and the like) can be suitably used. Further, as the after-heater 24, for example, an ultraviolet light source (UV light irradiators) may be used.

The controller 30 is, for example, a CPU of the printing apparatus 10, and controls the operation of each portion of the printing apparatus 10. For example, during each main scan, the controller 30 prompts the inkjet heads 102*c* to 102*k* to eject ink at timings set according to images to be printed. According to this embodiment, for example, a desired image can be appropriately printed using the instantaneous drying ink.

Figure 2A:
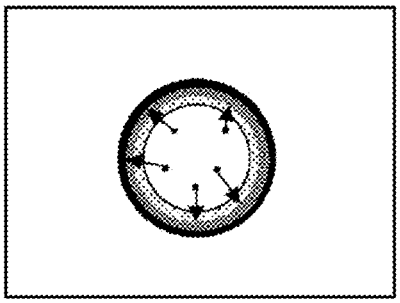
FIGS. 2A-2C are views and a graph for explaining a phenomenon that occurs after a color ink has landed on a medium 50.
Figure 2B:
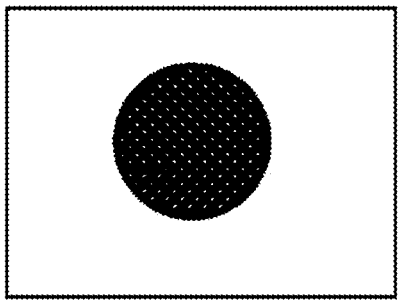
Figure 2C:
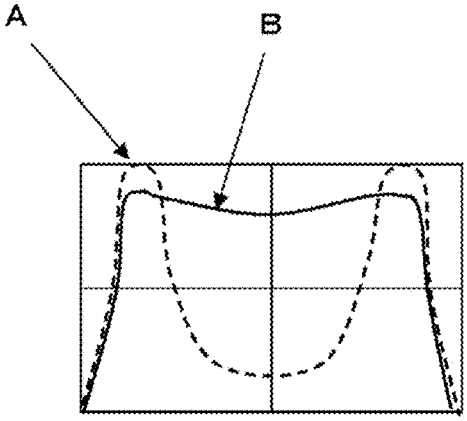

Subsequently, the features of the printing operation performed in this embodiment will be described in more detail. FIGS. 2A-2C are views and a graph for explaining a phenomenon that occurs after a color ink has landed on the medium 50. FIG. 2A is a view illustrating an example (conventional dry model) of how to dry the ink when using an instantaneous drying ink having a conventional configuration, and illustrates an example of a state of a dot formed by the color ink. FIG. 2B is a view illustrating an example (dry model of this embodiment) of how to dry the ink when using the instantaneous drying ink of this embodiment, and illustrates an example of a state of a dot formed by the color ink. For the sake of convenience of illustration, in FIGS. 2A and 2B, differences in color strength are schematically indicated by shading patterns. FIG. 2C is a graph comparing an ink density distribution (density distribution after drying) in a state illustrated in FIGS. 2A and 2B.

As described above, in this embodiment, an instantaneous drying color ink or the like is used, and the ink is dried by irradiation with ultraviolet rays. In this case, unlike the case where the ink is indirectly heated by heating the medium with a heater or the like, for example, the ink is directly heated by irradiation with ultraviolet rays, so that, for example, it is possible to efficiently and appropriately heat the ink while suppressing the influence on the surrounding configuration and the medium 50. Consequently, the ink can be heated to a higher temperature, for example, as compared with the case where the ink is heated using only a heater.

However, in this case, if only an instantaneous drying color ink having a conventional configuration is used, it is conceivable that, as the temperature of the ink increases, the viscosity of the ink temporarily lowers, and, as indicated by an arrow in FIG. 2A, for example, a flow of the ink component occurs from the central portion to the peripheral edge within dots of the ink formed by ink droplets landing on the medium. In this case, the use of instantaneous drying color ink having a conventional configuration means, for example, the use of instantaneous drying color ink which does not have the feature that the viscosity rapidly increases with the evaporation of the solvent as described above. Such a phenomenon can be considered as a phenomenon in which a coloring material of the ink such as a pigment tends to move to the peripheral edge of the dot due to temporarily lowering of the viscosity of the ink occurring during drying of the ink, and the coffee stain phenomenon is likely to occur. More specifically, in this case, for example, as illustrated in FIG. 2A, in a color density distribution (density distribution after drying) in the ink dot, the color is thin near the center and is dark at the peripheral portion. In this case, deterioration of image quality may occur due to influences such as occurrence of a thin portion of color of an image to be printed and a decrease of an average density of colored color. In addition, in this case, the color density distribution within the ink dot (density distribution within the dot) becomes like a curve shown by the broken line marked with reference letter A in FIG. 2C, for example. In this case, only the peripheral edge of the ink dot becomes high density, and in the center portion of the dot, a low density state in which the color is almost the background color of the medium 50 is obtained. As a result, for example, the coloring area ratio in the image may decrease, and the image may become thin.

On the other hand, in the case of using an instantaneous drying ink having such a feature that the viscosity increases rapidly with evaporation of the solvent as in this embodiment, immediately after landing of the color ink, the viscosity of the ink can be appropriately increased. In this case, even if the temperature of the color ink becomes high by irradiation with ultraviolet rays, since the viscosity of the color ink rapidly increases so as to prevent movement of the coloring material in the ink as well as evaporation of the solvent due to a temperature increase, the phenomenon in which the coloring material moves to the peripheral edge of the dot hardly occurs. More specifically, in this case, the viscosity of the color ink increases in a short time, so that it is possible to make lowering of the viscosity unlikely to occur in the process of evaporating and drying the color ink by irradiation with ultraviolet rays (during heat generation of the color ink). Consequently, for example, movement (movement in the evaporation and drying process) of the coloring material (such as particles of the pigment) in the ink occurring when the viscosity of the ink is low can be made unlikely to occur. Thus, according to this embodiment, for example, it is possible to appropriately prevent non-evaporating components (such as pigments) from gathering at the peripheral edge of the ink dot. Consequently, for example, it possible to properly prevent the occurrence of the coffee stain phenomenon, and the density of the ink dot can be appropriately increased to the center portion. In addition, in this case, the color density distribution within the ink dot becomes like a curve shown by the solid line marked with reference letter B in FIG. 2C, for example. In this case, as is apparent from the comparison with the curve marked with reference letter A, it is possible to appropriately realize a uniform density distribution up to the inside of the ink dot. Consequently, it is possible to appropriately increase the average density of a printed matter and to perform high-quality printing.

Subsequently, with respect to the ink used in this embodiment, the feature that the viscosity rapidly increases with evaporation of the solvent will be described in more detail. As described above, the viscosity of the ink to be used in this embodiment is 50 mPa·sec or more once 45% by volume or more of the solvent evaporates from the initial solvent amount by irradiation with ultraviolet rays. Once 45% by volume or more of the solvent evaporates from the initial solvent amount, the viscosity of the ink is preferably 100 mPa·sec or more, more preferably 500 mPa·sec or more. By using the ink having such features, it is possible to appropriately prevent the occurrence of the coffee stain phenomenon as described above.

More specifically, in this embodiment, as the ink, a latex ink (Latex ink) or the like having the above features can be suitably used. In this case, the use of the latex ink means the use of a latex ink (instantaneous drying latex ink) which generates heat by irradiation with ultraviolet rays. Unless otherwise specified, as various inks described above or to be described below, an ink (instantaneous drying ink) having a property of generating heat by irradiation with ultraviolet rays is used. Latex is, for example, a system in which fine particles of a polymer are dispersed in a stable state in a solvent such as water, for example. The latex ink is an ink containing components in the state of such a system. Further, the latex ink can be considered as an ink containing latex resin particles (Latex particles). In this case, as the latex resin particles, particles of a latex resin (for example, particles of a synthetic latex resin) dispersed in a solvent in a state in which the particle size is 30 nm to 1200 nm can be suitably used, for example. In this case, the particle size of the latex resin particles is, for example, a particle size (diameter) in design. When the particle size of the latex resin particles is 30 nm to 1200 nm, for example, among the latex resin particles contained in the ink, the particle size of the latex resin particles at a ratio of 70% (70% by weight) or more by weight is within this range. This ratio is preferably 80% or more, more preferably 90% or more.

In this case, in the state in which 45% by volume or more of the solvent evaporates from the initial solvent amount, for example, as the latex resin particles approach each other and the distance between the particles decreases, the viscosity of the ink rapidly increases. This is considered to be due to the fact that as the distance between the latex resin particles decreases, for example, an attractive force and a frictional force acting between the particles increase. In this case, for example, it is conceivable that, even when dispersants existing so as to surround the latex resin particles in the latex resin particles approach each other, the influence of increase in an inter-particle force and friction increases, and the viscosity of the ink increases. Thus, according to this embodiment, for example, by irradiating the ink with ultraviolet rays, it is possible to rapidly and appropriately increase the viscosity of the ink.

In the case of using the latex ink, it is conceivable that the rapid increase in viscosity as described above is caused by aggregation of components dispersed in the solvent. Thus, in the case of using the latex ink, the feature that the viscosity increases as described above can be considered as a feature that components dispersed in the solvent aggregate once 45% by volume or more of the solvent evaporates from the initial solvent amount. In this case, the component dispersed in the solvent means, for example, a component (for example, latex resin particles or the like) in which the amount of the solvent is dispersed in the solvent at the time of the initial solvent amount.

Figure 3A:
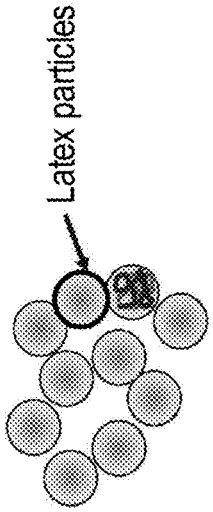
FIGS. 3A and 3B are a view and a graph for explaining how to increase viscosity in a latex ink.
Figure 3B:
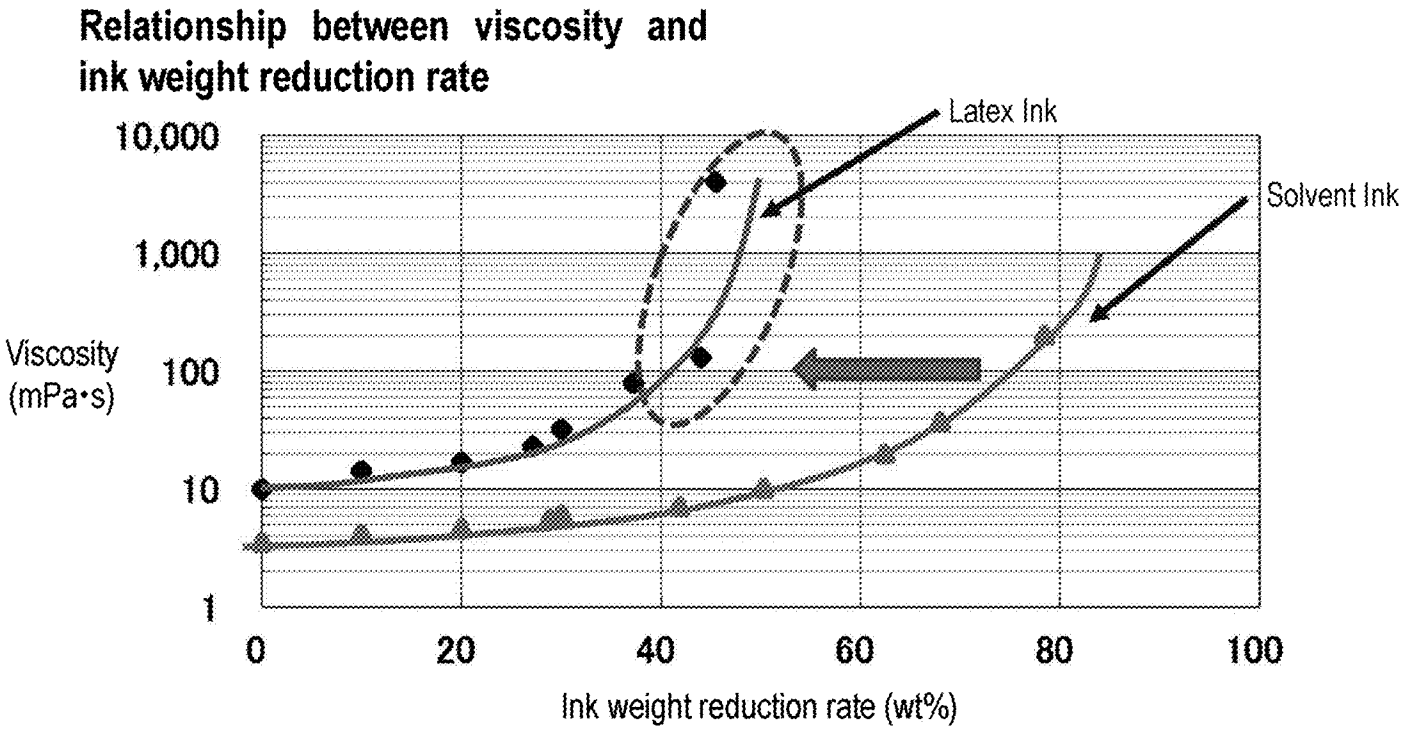

As to how to increase the viscosity in the latex ink, as described below with reference to FIGS. 3A and 3B, for example, it can be considered that viscosity increase with respect to evaporation of the solvent is faster than solvent ink or the like. FIGS. 3A and 3B are a view and a graph for explaining how to increase the viscosity in the latex ink. FIG. 3A is a view schematically illustrating latex resin particles (Latex particles) contained in the latex ink; FIG. 3B is a graph illustrating an example of a difference in viscosity change due to ink, and illustrates an example of a change in ink viscosity with a decrease in solvent due to evaporation for a latex ink and a solvent ink.

Here, in FIG. 3B, for the sake of convenience of illustration, a reduction amount of the solvent of the ink is illustrated by a relationship between the viscosity and an ink weight reduction rate and a reduction rate in weight ratio (ink weight reduction rate) as illustrated in the drawing. However, in this case as well, in terms of the volume ratio, the viscosity of the latex ink is 50 mPa·sec or more once 45% by volume or more of the solvent evaporates from the initial solvent amount. In this embodiment, it can be considered that spherical resin particles are dispersed in the latex ink as illustrated in FIG. 3A, for example. In this case, when the amount of the solvent decreases by about 40% by weight (wt %) from the initial amount due to evaporation of the solvent, the viscosity of the latex ink increases to about 100 mPa·sec or more (at least 50 mPa·sec or more). Further, in this case, considering the volume ratio, it is conceivable that the viscosity of the ink increases to about 100 mPa·sec or more (at least 50 mPa·sec or more) once 45% by volume or more of the solvent evaporates from the initial solvent amount. In this case, it can be considered that the latex ink satisfies, for example, the condition as a rapidly high viscosity ink. Thus, in this case, for example, even if the ink is heated by irradiation with ultraviolet rays so that the temperature of the ink becomes high, it is possible to appropriately prevent the viscosity of the ink from becoming too low. This also makes it possible, for example, to stop flowing and smearing of the ink at the initial stage of drying the ink and to effectively suppress the coffee stain phenomenon and the like.

On the other hand, as illustrated in contrast with the characteristics of the latex ink in FIG. 3B, in the case of using the solvent ink, even if the solvent of the ink decreases, the viscosity of the ink increases much more slowly than in the case of the latex ink. More specifically, for example, once the amount of the solvent decreases by about 40% by weight (wt %) from the initial amount due to evaporation of the solvent, the viscosity of the solvent ink is still about 10 mPa·sec or less.

Here, as also described above, in the latex ink, the latex resin particles are dispersed in the solvent of the ink. In this case, when the amount of the solvent decreases, the distance between the particles decreases, so that the components dispersed in the solvent aggregate, and the viscosity of the ink increases rapidly. On the other hand, in the case of the solvent ink, components such as a resin (binder resin) are not dispersed but dissolved in a solvent used as the solvent. In this case, even if the amount of the solvent decreases, aggregation or the like as in the case of the latex ink does not occur. As a result, it is conceivable that the viscosity increase in the case of the solvent ink is slower than in the case of the latex ink. As can be seen from the drawing, also in the case of the solvent ink, the viscosity increases greatly once the amount of the solvent decreases by about 80% by weight (wt %) from the initial amount. This is probably because components (binder resin and the like) dissolved in the solvent are not completely dissolved due to extremely small amount of the solvent.

As described above, in the case of using the latex ink, it can be conceivable that the above-described viscosity rapid increase occurs because the latex resin particles are dispersed in the solvent. In this case, the latex resin particles can be considered as, for example, an example of thickening substances. The thickening substance is, for example, a substance which increases the viscosity of the ink when the amount of the solvent in the ink decreases. The thickening substances can also be considered as a substance which increases the viscosity of the ink more rapidly than when the ink does not contain the substance. In the modification of the ink used in this embodiment, an ink other than the latex ink may be used as the ink whose viscosity increases rapidly as described above. Also in this case, an ink containing some thickening substance may be used.

Depending on properties of the thickening substance, it is not necessarily a substance which is dispersed in a solvent, but a substance which dissolves in a solvent or the like may be used. For example, when a substance having a sufficiently large molecular weight is used, even when the thickening substance is dissolved in the solvent, it is possible to rapidly increase the viscosity of the ink when the solvent is reduced. More specifically, in this case, for example, an ink containing a polymeric substance or an oligomer dissolved in a solvent may be used. In this case, the polymeric substance or oligomer can be considered as an example of thickening substances. In this case, for example, by using a polymeric substance or an oligomer having a sufficiently large molecular weight, once evaporation of the solvent of the ink progresses (for example, once 45% by volume or more of the solvent evaporates from the initial solvent amount), it is possible to appropriately increase the intermolecular force (for example, force between molecular chains) of the polymeric substance or oligomer. Further, in this case, in addition to the increase in the intermolecular force, entanglement between molecules (for example, entanglement between molecular chains) may occur. In this case, for example, the ink changes into a gel state, and the viscosity increases rapidly. Thus, according to this configuration, for example, by irradiating the ink with ultraviolet rays, it is possible to rapidly and appropriately increase the viscosity of the ink.

Figure 4A:
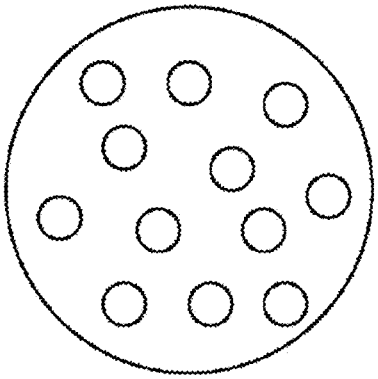
FIGS. 4A-4C are diagrams for explaining various modifications of ink having rapidly high viscosity evaporative drying characteristics.
Figure 4B:
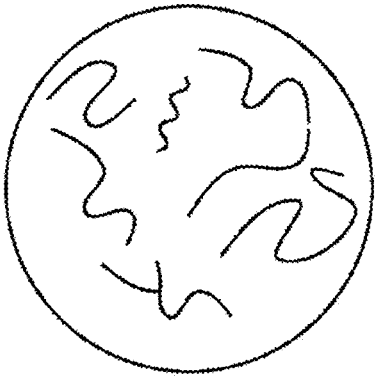
Figure 4C:
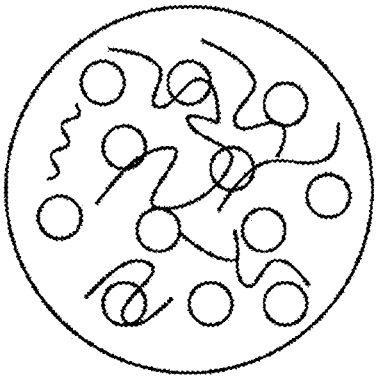

As an ink (ink having rapidly high viscosity evaporative drying characteristics) whose viscosity rapidly increases as described above, in addition to the above-described ink, various inks may be used. FIGS. 4A-4C are diagrams for explaining various modifications of ink having rapidly high viscosity evaporative drying characteristics.

First, the modification illustrated in FIG. 4A will be described. In this modification, as the ink, the colloidal ink is used. The colloidal ink contains coloring material-coated resin particles which are particles obtained by coating a coloring material with a resin such as a polymer resin. As a coloring material, a pigment may be used, for example. In this case, for example, the coloring agent-coated resin particles can be considered as capsule type coloring material particles in which individual pigment particles or a plurality of pigment particles are coated with a polymer resin in order to reduce electrostatic repulsion between the pigments. In this modification, the coloring agent-coated resin particles are dispersed in a solvent. When the amount of the solvent is reduced due to evaporation of the solvent, the distance between the coloring agent-coated resin particles decreases, for example, so that the viscosity of the ink rapidly increases in a way identical or similar to that in the case of the latex ink described above. Thus, in this modification, the coloring agent-coated resin particles can be considered as an example of thickening substances.

Here, the ink of this modification can be considered as an instantaneous drying ink (the next generation ink of an instantaneous drying type) obtained by adding, for example, an ultraviolet absorber to the ink (hereinafter referred to as the next generation ink) described as the ink of the present disclosure or the like in Japanese Unexamined Patent Publication No. 2013-241565. In this case, for example, by adjusting the amount of the coloring agent-coated resin particles or the dispersant to be added, it is possible to appropriately realize the ink whose viscosity rapidly increases as described above. Other than the above-described matters, the ink of this modification may have features identical or similar to the next generation ink disclosed in Japanese Unexamined Patent Publication No. 2013-241565. In the above description, for convenience of explanation, the ink of this modification is distinguished from the latex ink. However, the ink of this modification can also be considered as an ink (for example, a special latex ink) having the features of the latex ink.

Subsequently, the modifications and the like illustrated in FIGS. 4B and 4C will be described. In the above description, a thickening substance for rapidly increasing the viscosity of the ink has been described, mainly in the case of using a resin. However, as a thickening substance, a substance other than a resin may be used. As such a thickening substance, for example, a cellulose fiber which is a fiber of cellulose may be used. Such an ink can be considered as an instantaneous drying ink including cellulose fibers. In this case, if the solvent in the ink decreases due to evaporation, a distance between the cellulose fibers decreases, and the intermolecular force increases. In addition, the viscosity of the ink rapidly increases due to entanglement or the like.

As the cellulose fiber, for example, it is more preferable to use a cellulose nanofiber which is a cellulose fiber having an average fiber length of 1 μm or less. The average fiber length of the cellulose fiber is more preferably 700 nm or less (for example, about 50 nm to 700 nm). With such a configuration, for example, by irradiating the ink with ultraviolet rays, it is possible to more rapidly and appropriately increase the viscosity of the ink. As the cellulose fiber, a colorless and transparent one can be suitably used. With such a configuration, for example, the cellulose fiber can be appropriately added to the ink while suppressing the influence on the color of the ink.

As illustrated in FIG. 4B, for example, the cellulose fiber may be added to the ink in a state of being coated with a resin. In this case, the ink includes, for example, resin particles having cellulose fibers coated with a resin such as a polymer resin. With such a configuration, for example, it is possible to appropriately prevent occurrence of deviation of the cellulose fiber in the solvent. As compared with the case of directly adding the cellulose fiber, for example, an influence on ejection operation and the like can be made unlikely to occur. Thus, according to this modification, when the cellulose fiber is used as the thickening substance, the cellulose fiber can be added more appropriately. Depending on the required features of the ink and the like, the cellulose fiber may be added directly to the ink. In this case, the cellulose fiber is contained in the ink in a state of being directly dispersed in a solvent, for example.

In a further modification of the ink, a cellulose fiber may be further added to an ink containing a thickening substance other than the cellulose fiber. In this case, the cellulose fiber may be added to a latex ink of an instantaneous drying type, for example. For example, the cellulose fiber may be added to the next generation ink of an instantaneous drying type. When the cellulose fiber is added to the next generation ink of an instantaneous drying type, as illustrated in FIG. 4C, for example, the cellulose fiber may be further covered with a resin (coloring agent-coated resin particles) covering a coloring material. With this configuration, it is possible to properly add the cellulose fiber by taking advantage of the features of the next generation ink.

In the above description, the method of rapidly increasing the viscosity of the ink has been described, and the method (that is, a physical method) in which a physical force such as an intermolecular force acts on a substance functioning as a thickening substance to increase the viscosity has been mainly described. However, in a further modification of the ink, the viscosity of the ink may be increased by a chemical method that causes a chemical reaction to occur in a substance functioning as a thickening substance. More specifically, in this case, for example, an ink containing a polymerizable substance which is a substance to be polymerized by irradiation with energy rays such as ultraviolet rays may be used. In this case, as the polymerizable substance, for example, a monomer or oligomer of a resin (UV curable resin) which is cured by irradiation with ultraviolet rays may be used. In this case, such a polymerizable substance can be considered as a thickening substance. Further, in this case, the polymerizable substance is dissolved in the solvent of the ink, for example, initiates a polymerization reaction in response to irradiation with ultraviolet rays, and is polymerized. Consequently, the viscosity of the ink is rapidly increased Also in this case, the instantaneous drying ink may be used as the ink. In this case, the viscosity of the ink increases as the polymerization reaction occurs simultaneously with evaporation of the solvent of the ink. According to this configuration, for example, by irradiating the ink with energy rays, it is possible to rapidly and appropriately increase the viscosity of the ink. In this case, the ink may contain, for example, a substance which also serves as a polymerization initiator as an ultraviolet absorber which absorbs ultraviolet rays to generate heat. As the polymerization initiator, a substance different from the ultraviolet absorber for heating the ink may be added.

Figure 5:
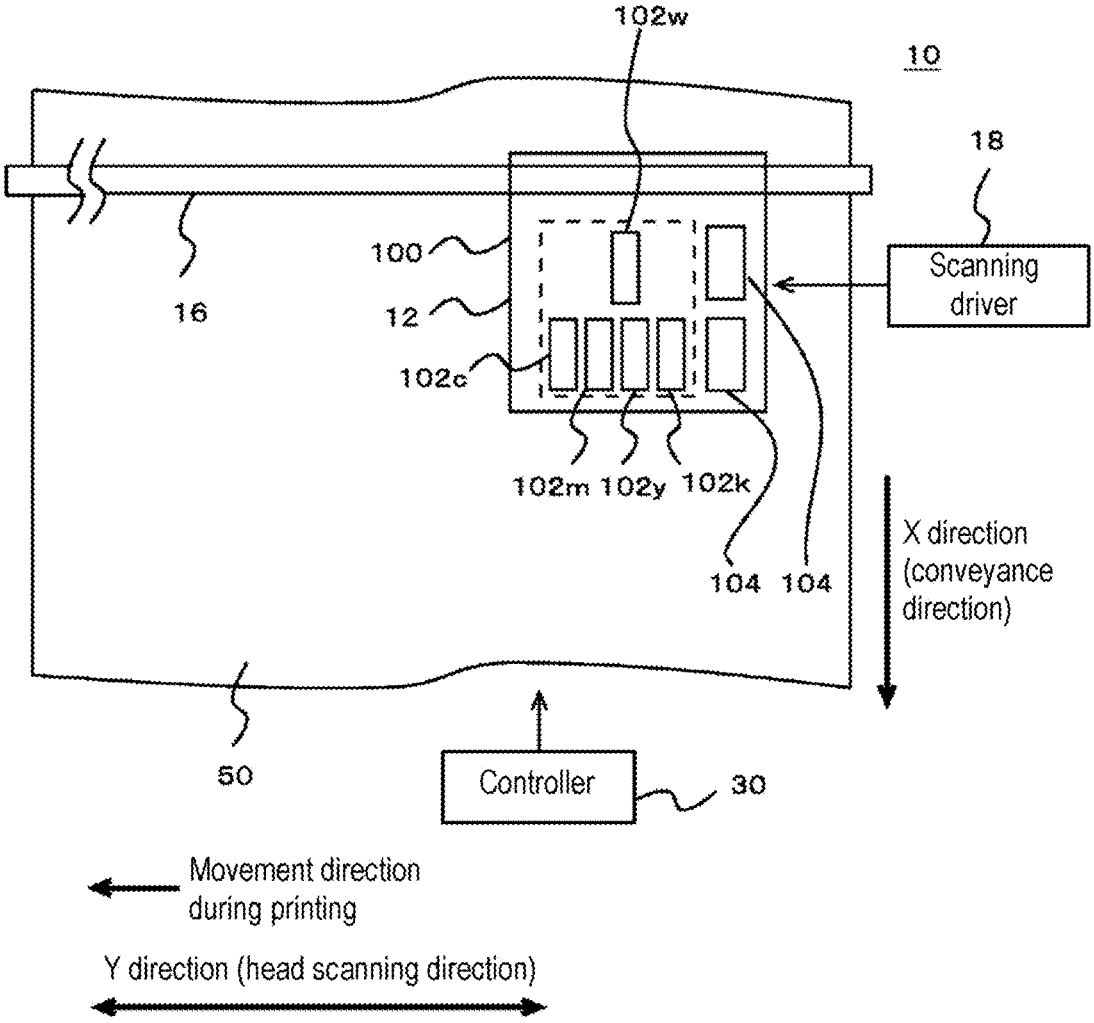
FIG. 5 is a top view illustrating a modification of the configuration of the printing apparatus 10.

As described above, inks of various configurations may be used as the ink having rapidly high viscosity evaporative drying characteristics. In this case, the specific configuration and the like of the printing apparatus 10 using the ink having rapidly high viscosity evaporative drying characteristics are not limited to the above-described configuration, and various modifications can be made. FIG. 5 is a top view illustrating a modification of the configuration of the printing apparatus 10. In FIG. 5, components denoted by the same reference symbols as those of FIGS. 1A and 1B have features identical or similar to those of the components of FIGS. 1A and 1B, except for points to be described below.

In this modification, the printing apparatus 10 performs printing by further using white ink. In this case, the white ink is an example of a special color ink. More specifically, the head portion 12 of this modification further includes an inkjet head 102*w* for white ink, in addition to the inkjet heads 102*c* to 102*k* for process color. As illustrated in the drawing, the inkjet head 102*w* is disposed so as to form different rows so as to be shifted in position in the sub scanning direction from the inkjet heads 102*c* to 102*k*. With such a configuration, for example, it is possible to properly perform undercoating and overcoating using a white ink. In accordance with such an arrangement of the inkjet heads, in this modification, the head portion 12 has the ultraviolet irradiation sections 104. One of the ultraviolet irradiation sections 104 is disposed at a position behind the inkjet heads 102*c* to 102*k* in the moving direction of the head portion 12 during the main scan while aligning the position in the sub scanning direction with the inkjet heads 102*c* to 102*k*, in a way identical or similar to the ultraviolet irradiation section 104 in FIGS. 1A and 1B. Another one of the ultraviolet irradiation sections 104 is disposed at a position behind the inkjet head 102*w* in the moving direction of the head portion 12 during the main scan while aligning the position in the sub scanning direction with the inkjet head 102*w*.

In this modification, an ink having rapidly high viscosity evaporative drying characteristics is used as while ink and the inks of CMYK. Thus, also in this modification, it is possible to obtain the same effect as in the case described above with reference to FIGS. 1A-4C. Further, in a further modification of the configuration of the printing apparatus 10, for example, the inkjet heads 102*c* to 102*k* for process color may be arranged in different rows so as to be shifted in position in the sub scanning direction for each color. In the above description, for the configuration of the printing apparatus 10, an example of the configuration in the case of performing main scan in unidirection (unidirectional printing) has been described mainly. However, in a further modification of the configuration of the printing apparatus 10, a configuration that performs a reciprocating main scan (bi-directional printing) may be used as the configuration of the printing apparatus 10. In this case, it is preferable that the ultraviolet irradiation section 104 be disposed not only on one side but on both sides in the main scanning direction with respect to the corresponding inkjet head. The configuration of the printing apparatus 10 is not limited to the serial type configuration, but a line type configuration (line printer) may be used. In this case, the line type configuration is, for example, a configuration in which ink is ejected from the inkjet head while conveying the medium in a predetermined direction without moving the position of the inkjet head. Also in these cases, by using the ink having rapidly high viscosity evaporative drying characteristics, for example, the occurrence of the coffee stain phenomenon and the like is prevented, and high-quality printing can be appropriately performed.

Next, a supplementary explanation related to the respective configurations described above will be made, and further modifications will be described. First, the effects and the like obtained by the respective configurations described above will be described again. For convenience of explanation, in the following description, the configurations described above are collectively referred to as this embodiment.

As also described above, in this embodiment, the instantaneous drying ink is used, and printing is performed by a method (UV instantaneous drying method) of instantaneously drying ink by irradiation with ultraviolet rays. In this case, the ink is instantaneously fixed on the medium to suppress occurrence of smearing, and high-speed printing can be performed. In general, as the instantaneous drying ink, for example, an ink prepared by adding an ultraviolet absorber to various known evaporation drying type inks can be used. As known evaporation drying type inks, for example, known solvent inks, aqueous inks, latex inks, other emulsion type inks, and the like can be used. In this case, by using the instantaneous drying ink, for example, even in the case of using a medium on which it is difficult to perform printing directly due to smearing or the like in an ordinary instantaneous drying ink, printing directly on the medium can be appropriately performed. For example, when an aqueous ink of an instantaneous drying type is used, printing can be appropriately performed on an absorbent medium such as paper or cloth or non-absorbent medium such as various plastic films, metals, and glasses. In this case, high resolution and high image quality printing can be appropriately performed, for example, by appropriately suppressing occurrence of smearing.

More specifically, in the case of using the instantaneous drying ink, for example, even when printing is performed at high speed while reducing the number of printing passes, it is possible to appropriately prevent occurrence of smearing. Thus, for example, it is possible to appropriately realize a high-speed printer which performs printing at high speed. As the printing apparatus 10, it is possible to use the printing apparatuses 10 of various configurations from a one-pass method to a multipass method (multipass printing). By appropriately preventing occurrence of smearing, it is also possible to realize a media free configuration using various media, for example. Consequently, as described above, for example, even in the case of using a medium or the like which has been unable to be used due to exacerbation of the problem of smearing in the conventional evaporation drying type ink, it is possible to eject ink directly thereto and to perform high definition printing. In this case, as the medium, for example, various media such as a medium in which a receptor layer is not formed, an absorbent (permeable) medium, and a non-absorbent (impermeable) medium can be widely used.

In the case of using the instantaneous drying ink, the ink can be directly and efficiently heated as compared with a configuration in which the ink is indirectly heated via a medium using a heater or the like. As in each configuration described above, when ultraviolet rays are used as energy rays, for example, the ultraviolet rays can penetrate into the interior of the ink adhering to the medium to heat the ink from the interior. Thus, for example, even when a film is formed on the surface of the ink during drying of the ink, it is possible to more appropriately dry the ink at a portion surrounded by the film. In the case of using the instantaneous drying ink, it is possible to realize, for example, miniaturization and cost reduction of the apparatus and power saving, as compared with the case of using a heater. More specifically, in the case of using the instantaneous drying ink, for example, the configuration for heat dissipation can be simplified, whereby the size and cost of the apparatus can be reduced, as compared with the case of using a heater. In addition, the power saving can be realized so that the average power consumption is about not more than a few tenths and the standby power is zero.

As described above, in this embodiment, instead of mere instantaneous drying ink, the ink having rapidly high viscosity evaporative drying characteristics whose viscosity rapidly increases with evaporation of the solvent is used. In this case, as described above, it is possible to appropriately suppress occurrence of the coffee stain phenomenon and to appropriately perform high-quality printing. In addition, the viscosity of the ink is increased in a short time, and the occurrence of the coffee stain phenomenon is appropriately suppressed, so that, for example, it is also possible to appropriately obtain a printing result with high density and without bleeding.

Here, as a method of suppressing ink smearing, there are conventionally known a method in which a flocculant (or coagulant) for flocculating (or coagulating) the ink, or the like is ejected to a medium in advance, and then printing with color ink is performed. In this case, by flocculating (or coagulating) the ink, it is also conceivable that the coffee stain phenomenon can be prevented even when an ink containing a pigment or the like is used as a coloring material, for example. However, in the case of using printing by such a method, for example, when an absorbent paper or cloth made of fibers is used as a medium, a large amount of liquid is absorbed by the medium, so that problems of curling and cockling of the medium tend to occur. As a result, meandering of the conveyed medium, contact between the inkjet head and the medium, and the like occur, which may cause a problem of quality deterioration (impairment of image quality) of an image to be printed. Curling, cockling, and the like are particularly likely to occur, for example when double-sided printing is performed on a medium. On the other hand, according to this embodiment, ink smearing and the coffee stain phenomenon can appropriately be prevented without using a flocculant or the like. This also makes it possible to prevent curling, cockling, and the like from occurring even when using an absorbent medium, for example.

In this embodiment, since the viscosity of the ink can be increased in a short time, it is possible to appropriately prevent smearing even when the ink is irradiated with ultraviolet rays under milder conditions, for example. In this case, for example, bumping of ink can be prevented by irradiating the ink with ultraviolet rays under mild conditions. Consequently, for example, surface roughening of the ink or the like can be appropriately prevented.

In this case, for example, even when the boiling point of the solvent is low, the occurrence of smearing can be appropriately suppressed by increasing the viscosity of the ink in a short time. Consequently, surface roughening of the ink or the like can be more appropriately prevented. More specifically, in the case of drying the ink by irradiation with ultraviolet rays, if the boiling point of the solvent of the ink is low, irradiation energy of ultraviolet rays becomes excessive, for example, only by irradiation with ultraviolet rays in a short time, so that bumping of the solvent is likely to occur. When the solvent bumps during drying of the ink, the ink surface becomes a porous film, so that problems such as surface roughening are likely to occur. As a result, it becomes difficult to perform high-gross printing. Even if it does not reach the bumping phenomenon, for example, in a case where printing is performed on an impermeable medium such as plastic with an ink having a low boiling point of the solvent, if ultraviolet rays are applied immediately after landing, the ink is dried before the surface of the ink is sufficiently flattened, so that the surface tends to be matte. Thus, also in such a case, it becomes difficult to perform high-gross printing.

Thus, in this embodiment, as the ink, for example, it is preferable to use an ink in which a liquid having a boiling point of 100° C. or higher occupies 50% by weight or more in a solvent contained in the ink at the time of ejection from the inkjet head. With such a configuration, for example, bumping of the solvent of the ink or the like can be made less likely to occur. In this case, for example, ultraviolet rays may be applied under the condition that the ink on the medium does not boil, and the ink may be dried. With such a configuration, for example, surface roughening of the ink or the like can be appropriately prevented. For example, even when an impermeable medium such as plastic is used, the surface of the ink can be appropriately flattened by drying the ink over a certain period of time.

When ultraviolet rays are applied such that the solvent of the ink does not boil, it seems that ink smearing tends to occur due to a mild temperature increase of the ink. However, in this embodiment, as described above, the ink whose viscosity rapidly increases with evaporation of the solvent is used. In this case, even when the temperature increase of the ink is mild, it is possible to appropriately suppress occurrence of smearing. From a viewpoint other than the above-mentioned viewpoints, a maximum supplied energy of ultraviolet rays applied to the ink on the medium may be set within a range in which burning does not occur in the ink or the like, for example. In this case, the maximum supplied energy is, for example, the maximum value of the energy of the applied ultraviolet rays. In this case, the energy of the applied ultraviolet rays (the energy corresponding to a cumulative light quantity) depends on the irradiation intensity and irradiation time of the ultraviolet irradiation section 104 (see FIGS. 1A and 1B). It is conceivable that the irradiation time varies according to printing conditions such as the printing speed, the number of printing passes, and printing dot density. Thus, it is preferable that the maximum supplied energy be appropriately adjusted within the range in which burning does not occur in the ink or the like automatically or by manual operation of a user in accordance with these conditions.

From the various viewpoints described above, it is preferable to use the ink having the following features (i) to (iv) as the ink having rapidly high viscosity evaporative drying characteristics. When the ink having such features is used and dried by irradiation with ultraviolet rays, for example, it is possible to appropriately prevent the coffee stain phenomenon, roughening of the ink, and smearing.

(i) 50% by weight or more of all solvents in the ink is a liquid (such as water or an organic solvent) having a boiling point of 100° C. or more.

(ii) An ultraviolet absorber that absorbs ultraviolet rays within a wavelength range of 300 nm to 490 nm is added to the ink. In this case, the ultraviolet absorber absorbs ultraviolet rays, thereby increasing the temperature of the solvent in the ink and evaporating and drying the ink. The amount of the ultraviolet absorber to be added is preferably 0.05% by weight or more and 20% by weight or less based on the weight of all solvents. The ultraviolet absorber may be either organic or inorganic.

(iii) The ink contains inorganic or organic coloring materials, dispersants, various thickening substances, and the like as necessary. As the thickening substance, additives which cause rapid thickening action, such as various binder resins, rosin or cellulose derivatives, acrylic acid derivatives, and thickening agents such as polyvinyl alcohol, may be used. Further, as the thickening substance, a resin (UV curable resin) polymerized by ultraviolet curing (UV curing) to increase its viscosity may be used, for example.

(iv) Rapid thickening to a viscosity of 50 mPa·sec or more occurs with evaporation of at least 45% by volume or more of the solvent of the initial solvent amount in the ink (expression of the rapidly high viscosity evaporative drying characteristics). This condition can be considered as a condition that viscosity increase occurs rapidly at a stage where the solvent is larger than solvent ink or the like in which the resin is dissolved in the solvent.

As for specific conditions and the like in the case of printing in this embodiment, various modifications besides the matters described above can be made. For example, the medium used in this embodiment is not particularly limited. Also, the printing speed, intended purposes, and the like are not particularly limited. More specifically, in the case of using the instantaneous drying ink as in this embodiment, for example, even when high-speed printing is performed on a medium in which smearing is likely to occur due to absorbability of paper, cloth, a sewn product such as a T-shirt, or the like, occurrence of smearing during printing can be appropriately prevented. Thus, in this embodiment, these media can be suitably used. Not only when such an absorbent medium is used, but also when a non-absorbent medium such as a vinyl chloride sheet or various plastic films is used during printing, the effect of preventing smearing by rapid drying and the like can be obtained appropriately.

Specific configurations of the printing apparatus 10 can be further variously modified. For example, the position where the ultraviolet irradiation section is disposed can be variously changed according to the configuration of the printing apparatus 10 and the like. In this case, for example, the ultraviolet irradiation section may be installed at a position conforming to a scanning type such as a serial type or a line type. In the case of a line type configuration, for example, an ultraviolet irradiation section may be individually disposed on the downstream side of an inkjet head for each color of CMYK. Alternatively, an inkjet head is disposed on the downstream side of a plurality of inkjet heads for respective colors of CMYK, and ultraviolet rays may be applied collectively to inks of the respective colors of CMYK.

The color of the ink to be used is not limited to the color described above, but inks of various colors may be used. For example, inks used as color inks are not limited to inks of process colors such as CMYK, and, depending on the purpose of printing and the like, inks of R (red), G (green), and B (blue) colors and other special colors may be used. As the inks of special colors, in addition to white color ink, metallic colored inks and pearl-colored inks may be used, for example. Further, as the ink of a special color, an ink of a clear color may be used, for example. When ink of each color of RGB is used, each color of CMY can be considered as a primary color, and each color of RGB can be considered as a secondary color. In this case, the secondary color is, for example, a color obtained by mixing a plurality of primary colors in principle. In this case, the inkjet heads for secondary colors may be arranged so as to be shifted in position in the sub scanning direction from the inkjet heads for primary colors. With this configuration, for example, it is possible to appropriately reduce the total amount of ink to be ejected with respect to the unit area in each main scan. Consequently, for example, occurrence of smearing can be more appropriately suppressed, and highly brilliant printing can be performed more appropriately. In this case, it possible to more reliably prevent curling, cockling, and the like from occurring even when using an absorbent medium or the like, for example.

INDUSTRIAL APPLICABILITY

The present disclosure can be suitably used, for example, in a printing apparatus.

What is claimed is:

1. A printing apparatus which performs printing on a medium in an inkjet mode, comprising:

an inkjet head which ejects an ink to the medium; and an energy ray irradiator which applies an energy ray, wherein the ink is an ink containing a solvent and generating heat in accordance with the energy ray, the energy ray irradiator applies the energy ray to the ink on the medium to evaporate at least a portion of the solvent in the ink, and the energy ray irradiator applies the energy ray to the ink on the medium, so that a viscosity of the ink is 50 mPa·sec or more, when 45% by volume or more of the solvent evaporates from an initial solvent amount which is an amount of the solvent contained in the ink at a time of ejection from the inkjet head.

2. The printing apparatus according to claim 1, wherein the ink contains a thickening substance which is a substance that increases the viscosity of the ink when the amount of the solvent in the ink decreases, and the thickening substance aggregates when the amount of the solvent in the ink decreases to increase the viscosity of the ink.

3. The printing apparatus according to claim 2, wherein the ink is an ink containing latex resin particles.

4. The printing apparatus according to claim 3, wherein when 45% by volume or more of the solvent evaporates from the initial solvent amount, as a distance between the latex resin particles decreases, the viscosity of the ink increases.

5. The printing apparatus according to claim 2, wherein the ink contains a polymeric substance or an oligomer dissolved in the solvent.

6. The printing apparatus according to claim 5, wherein when 45% by volume or more of the solvent evaporates from the initial solvent amount, an intermolecular force of the polymeric substance or oligomer increases, and, at the same time, entanglement occurs between molecules, so that the viscosity of the ink increases.

7. The printing apparatus according to claim 2, wherein the ink contains a polymerizable substance which is a substance to be polymerized by irradiation with the energy ray.

8. The printing apparatus according to claim 2, wherein the ink is a colloidal ink, containing: coloring material-coated resin particles which are particles obtained by coating a coloring material with a resin.

9. The printing apparatus according to claim 1, wherein the ink is an ink containing latex resin particles.

10. The printing apparatus according to claim 9, wherein when 45% by volume or more of the solvent evaporates from the initial solvent amount, as a distance between the latex resin particles decreases, the viscosity of the ink increases.

11. The printing apparatus according to claim 1, wherein the ink contains a polymeric substance or an oligomer dissolved in the solvent.

12. The printing apparatus according to claim 11, wherein when 45% by volume or more of the solvent evaporates from the initial solvent amount, an intermolecular force of the polymeric substance or oligomer increases, and, at the same time, entanglement occurs between molecules, so that the viscosity of the ink increases.

13. The printing apparatus according to claim 1, wherein the ink contains a polymerizable substance which is a substance to be polymerized by irradiation with the energy ray.

14. The printing apparatus according to claim 1, wherein the ink is a colloidal ink, containing: coloring material-coated resin particles which are particles obtained by coating a coloring material with a resin.

15. The printing apparatus according to claim 1, wherein the ink comprises a cellulose fiber which is a fiber of cellulose.

16. The printing apparatus according to claim 1, wherein the energy ray irradiator applies an ultraviolet ray as the energy ray.

17. A printing apparatus which performs printing on a medium in an inkjet mode, comprising:

an inkjet head which ejects an ink to the medium; and an energy ray irradiator which applies an energy ray, wherein the ink is an ink containing a solvent and generating heat in accordance with the energy ray, the energy ray irradiator applies the energy ray to the ink on the medium to evaporate at least a portion of the solvent in the ink, and the ink comprises a cellulose fiber which is a fiber of cellulose;

wherein the energy ray is an ultraviolet ray, and the ink further comprises an ultraviolet absorber that absorbs the ultraviolet ray and generates heat.

18. A print method which performs printing on a medium in an inkjet mode, comprising:

ejecting an ink to the medium by an inkjet head; and applying an energy ray by an energy ray irradiator, wherein the ink is an ink containing a solvent and generating heat in accordance with the energy ray, the energy ray irradiator applies the energy ray to the ink on the medium to evaporate at least a portion of the solvent in the ink, and the ink comprises a cellulose fiber which is a fiber of cellulose;

wherein the energy ray is an ultraviolet ray, and the ink further comprises an ultraviolet absorber that absorbs the ultraviolet ray and generates heat.

* * * * *